US008408016B2

(12) United States Patent
McCollough et al.

(10) Patent No.: US 8,408,016 B2
(45) Date of Patent: Apr. 2, 2013

(54) ICE MAKER WITH ROTATING ICE MOLD AND COUNTER-ROTATING EJECTION ASSEMBLY

(75) Inventors: Thomas Woodrow McCollough, Anderson, SC (US); Edward M. Young, Williamston, SC (US); Aaron Arvia, Anderson, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 314 days.

(21) Appl. No.: 12/768,303

(22) Filed: Apr. 27, 2010

(65) Prior Publication Data

US 2011/0259037 A1 Oct. 27, 2011

(51) Int. Cl.
*F25C 1/00* (2006.01)

(52) U.S. Cl. ..... 62/135

(58) Field of Classification Search ..... 62/72, 135, 62/345, 353, 137, 138
See application file for complete search history.

(56) References Cited

U.S. PATENT DOCUMENTS

| | | | | |
|---|---|---|---|---|
| 2,145,773 | A | 1/1939 | Muffly | |
| 2,145,775 | A | 1/1939 | Muffly | |
| 2,291,826 | A | 8/1942 | Muffly | |
| 2,315,460 | A | 3/1943 | Steenstrup | |
| 2,359,780 | A | 10/1944 | Muffly | |
| 2,493,488 | A | 1/1950 | Jordan et al. | |
| 2,544,394 | A | 3/1951 | Muffly | |
| 2,717,504 | A * | 9/1955 | Knerr | 62/137 |
| 2,846,854 | A | 8/1958 | Galin | |
| 2,866,322 | A | 12/1958 | Muffly | |
| 3,393,531 | A | 7/1968 | Parr | |
| 3,712,076 | A * | 1/1973 | Fox | 62/137 |
| 3,788,089 | A | 1/1974 | Graves | |
| 3,863,461 | A * | 2/1975 | Bright | 62/137 |
| 3,926,007 | A * | 12/1975 | Braden et al. | 62/137 |
| 4,083,196 | A | 4/1978 | Karll | |
| 4,142,377 | A * | 3/1979 | Fogt | 62/135 |
| 4,147,039 | A | 4/1979 | Blomberg | |

(Continued)

FOREIGN PATENT DOCUMENTS

| | | |
|---|---|---|
| CN | 1598451 | 3/2005 |
| CN | 1683884 | 10/2005 |

(Continued)

OTHER PUBLICATIONS

Machine translation of WO2006076976A1.*

(Continued)

*Primary Examiner* — Janet M Wilkens
*Assistant Examiner* — Andrew Roersma
(74) *Attorney, Agent, or Firm* — Pearne & Gordon LLP

(57) ABSTRACT

An ice maker includes an ice mold and a sweeping element. The ice mold includes a plurality of cavities and is configured to be rotatable about an axis that is spaced apart from the cavities and extends longitudinally with respect to the ice mold. The sweeping element is configured to be rotatable about the axis and includes a shaft with a plurality of fingers radially extending from the shaft. Each of the fingers is configured to extend into a corresponding one of the cavities upon rotation of the shaft about the axis. During a harvesting step, the ice mold is configured to rotate in a first direction about the axis while the sweeping element is configured to rotate in a second direction about the axis that is opposite the first direction.

12 Claims, 5 Drawing Sheets

U.S. PATENT DOCUMENTS

| | | | | |
|---|---|---|---|---|
| 4,184,339 | A | 1/1980 | Wessa | |
| 4,306,423 | A | 12/1981 | Webb et al. | |
| 4,774,815 | A | 10/1988 | Schlosser | |
| 4,907,422 | A | 3/1990 | Kohl et al. | |
| 5,065,584 | A | 11/1991 | Byczynski et al. | |
| 5,212,955 | A * | 5/1993 | Hogan | 62/73 |
| 5,212,957 | A | 5/1993 | Ruff | |
| 5,231,847 | A | 8/1993 | Cur et al. | |
| 5,375,432 | A | 12/1994 | Cur | |
| 5,400,605 | A | 3/1995 | Jeong | |
| 5,406,805 | A | 4/1995 | Radermacher et al. | |
| 5,575,833 | A | 11/1996 | Griffin | |
| 5,755,113 | A | 5/1998 | Ferguson et al. | |
| 5,970,725 | A * | 10/1999 | Lee | 62/137 |
| 5,992,167 | A | 11/1999 | Hill et al. | |
| 6,112,540 | A | 9/2000 | Serrels et al. | |
| 6,460,357 | B1 | 10/2002 | Doi et al. | |
| 6,571,567 | B2 | 6/2003 | An et al. | |
| 6,681,596 | B2 | 1/2004 | Kentner et al. | |
| 6,735,959 | B1 | 5/2004 | Najewicz | |
| 6,775,998 | B2 | 8/2004 | Yuasa et al. | |
| 6,845,631 | B1 | 1/2005 | Hallin et al. | |
| 6,938,428 | B2 * | 9/2005 | Onishi et al. | 62/135 |
| 6,964,177 | B2 | 11/2005 | Lee et al. | |
| 7,201,014 | B2 | 4/2007 | Hornung | |
| 7,201,015 | B2 | 4/2007 | Feldman et al. | |
| 7,287,397 | B2 | 10/2007 | Coulter et al. | |
| 7,406,838 | B2 | 8/2008 | Wang | |
| 2002/0069654 | A1 | 6/2002 | Doi et al. | |
| 2004/0050083 | A1 | 3/2004 | Yuasa et al. | |
| 2005/0061009 | A1 | 3/2005 | Flinner et al. | |
| 2005/0061016 | A1 | 3/2005 | Lee et al. | |
| 2005/0061018 | A1 | 3/2005 | Kim et al. | |
| 2005/0132733 | A1 | 6/2005 | Rafalovich et al. | |
| 2005/0217310 | A1 | 10/2005 | Luehrs et al. | |
| 2006/0016209 | A1 * | 1/2006 | Cole et al. | 62/344 |
| 2006/0086134 | A1 | 4/2006 | Voglewede et al. | |
| 2006/0086135 | A1 * | 4/2006 | Wu et al. | 62/351 |
| 2006/0174646 | A1 * | 8/2006 | Comerci et al. | 62/340 |
| 2006/0179869 | A1 | 8/2006 | Lee et al. | |
| 2006/0242986 | A1 | 11/2006 | Sugaya et al. | |
| 2006/0266055 | A1 | 11/2006 | Anderson et al. | |
| 2006/0266065 | A1 | 11/2006 | Anderson et al. | |
| 2007/0163282 | A1 | 7/2007 | Cushman et al. | |
| 2009/0019880 | A1 * | 1/2009 | Lee et al. | 62/345 |
| 2009/0145159 | A1 * | 6/2009 | Kim et al. | 62/353 |
| 2010/0218542 | A1 * | 9/2010 | McCollough et al. | 62/345 |

FOREIGN PATENT DOCUMENTS

| | | |
|---|---|---|
| DE | 10336830 | 3/2005 |
| DE | 10336834 | 3/2005 |
| EP | 1559972 | 8/2005 |
| EP | 1559973 | 8/2005 |
| EP | 1798500 | 6/2007 |
| JP | 2000009372 | 1/2000 |
| JP | 2000011129 | 1/2000 |
| WO | 2004092661 | 10/2004 |
| WO | WO 2006076976 A1 * | 7/2006 |

OTHER PUBLICATIONS

Partial International Search Report for PCT/US2011/033561 dated Sep. 12, 2011, 2 pages.

* cited by examiner

ICE MAKER WITH ROTATING ICE MOLD AND COUNTER-ROTATING EJECTION ASSEMBLY

FIELD OF THE INVENTION

The present invention relates generally to ice makers, and more particularly, to assemblies for ejecting ice cubes from an ice mold.

BACKGROUND OF THE INVENTION

Refrigerator ice makers generally require a mechanism for ejecting ice cubes from cavities of an ice mold and for moving them to an ice storage area. One such mechanism utilizes moving or rotating fingers to push or dig the ice cubes out of the cavities. One problem that may occur in this mechanism is that there may be inconsistencies in the size of an ice cube and a small ice cube may get stuck between the fingers, between a finger and the ice mold, or somewhere else so as to jam the ejection mechanism. This can lead to an extended period of time where the ice maker does not function properly until the ice cube is either removed by an operator or the blockage is undone by melting and/or sublimation which may take several days.

Thus, there is a need for an ice ejection mechanism that is more reliable and less prone to blockages caused by ice cubes.

BRIEF SUMMARY OF THE INVENTION

The following presents a simplified summary of the disclosure in order to provide a basic understanding of some example aspects described in the detailed description.

In one example aspect, an ice maker includes an ice mold and a sweeping element. The ice mold includes a plurality of cavities and is configured to be rotatable about an axis that is spaced apart from the cavities and extends longitudinally with respect to the ice mold. The sweeping element is configured to be rotatable about the axis and includes a shaft with a plurality of fingers radially extending from the shaft. Each of the fingers is configured to extend into a corresponding one of the cavities upon rotation of the shaft about the axis. During a harvesting step, the ice mold is configured to rotate in a first direction about the axis while the sweeping element is configured to rotate in a second direction about the axis that is opposite the first direction.

In another example aspect, during the harvesting step, the ice mold is rotated about 90 degrees in the first direction about the axis while the sweeping element is rotated about 90 degrees in the second direction about the axis.

In yet another example aspect, the fingers and the ice mold move from a substantially horizontal position to a substantially vertical position during the harvesting step.

In yet another example aspect, the ice maker further comprises a crank and a gear train including a first gear and a second gear. The ice mold is interlocked to rotate with the first gear. The sweeping element is interlocked to rotate with the second gear that is concentric and rotatable about the first gear. The crank is operatively connected to the first gear to rotate in the first direction, and the second gear operatively connected via the gear train to the first gear to rotate in the second direction.

In yet another example aspect, the fingers are arranged sequentially along the shaft so as to be incrementally offset in angular position from a default angular position.

In yet another example aspect, each finger terminates in a blade section that is shaped to substantially trace an inner geometry of the cavities upon rotation during the harvesting step.

In yet another example aspect, each cavity is semi-wheel shaped and the blade section is circular so that a segment of a torus that is traced by the blade section through the rotation of one of the fingers substantially fits each cavity.

In yet another example aspect, the ice mold includes a pair of tabs at longitudinal ends, and the shaft extends between the tabs.

In yet another example aspect, an ice maker includes an ice mold and a sweeping element. The ice mold includes a plurality of cavities and is configured to be rotatable about an axis that is spaced apart from the cavities and extends longitudinally with respect to the ice mold. The sweeping element is configured to be rotatable about the axis and includes a shaft with a plurality of fingers radially extending from the shaft. Each of the fingers is configured to extend into a corresponding one of the cavities upon rotation of the shaft about the axis. The fingers are arranged sequentially along the shaft so as to be incrementally offset in angular position from a default angular position.

In yet another example aspect, each finger terminates in a blade section that is shaped to substantially trace an inner geometry of the cavities upon rotation during a harvesting step.

In yet another example aspect, during a harvesting step, the ice mold is configured to rotate in a first direction about the axis while the sweeping element is configured to rotate in a second direction about the axis that is opposite the first direction.

In yet another example aspect, during the harvesting step, the ice mold is rotated about 90 degrees in the first direction about the axis while the sweeping element is rotated about 90 degrees in the second direction about the axis.

In yet another example aspect, the fingers and the ice mold move from a substantially horizontal position to a substantially vertical position during the harvesting step.

In yet another example aspect, each cavity is semi-wheel shaped and the blade section is circular so that a segment of a torus that is traced by the blade section through the rotation of one of the fingers substantially fits each cavity.

In yet another example aspect, the ice mold includes a pair of tabs at longitudinal ends, and the shaft extends between the tabs.

In yet another example aspect, the ice maker further comprises a crank and a gear train including a first gear and a second gear. The ice mold is interlocked to rotate with the first gear. The sweeping element is interlocked to rotate with the second gear that is concentric and rotatable about the first gear. The crank is operatively connected to the first gear to rotate in the first direction, and the second gear operatively connected via the gear train to the first gear to rotate in the second direction.

In yet another example aspect, an ice maker includes an ice mold and a sweeping element. The ice mold includes a plurality of cavities and is configured to be rotatable about an axis that is spaced apart from the cavities and extends longitudinally with respect to the ice mold. The sweeping element is configured to be rotatable about the axis and includes a shaft with a plurality of fingers radially extending from the shaft. Each of the fingers is configured to extend into a corresponding one of the cavities upon rotation of the shaft about the axis. Each finger terminates in a blade section that is shaped to substantially trace an inner geometry of the cavities upon rotation during a harvesting step.

In yet another example aspect, each cavity is semi-wheel shaped and the blade section is circular so that a segment of a torus that is traced by the blade section through the rotation of one of the fingers substantially fits each cavity.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLES OF EMBODIMENTS

Figure 1:
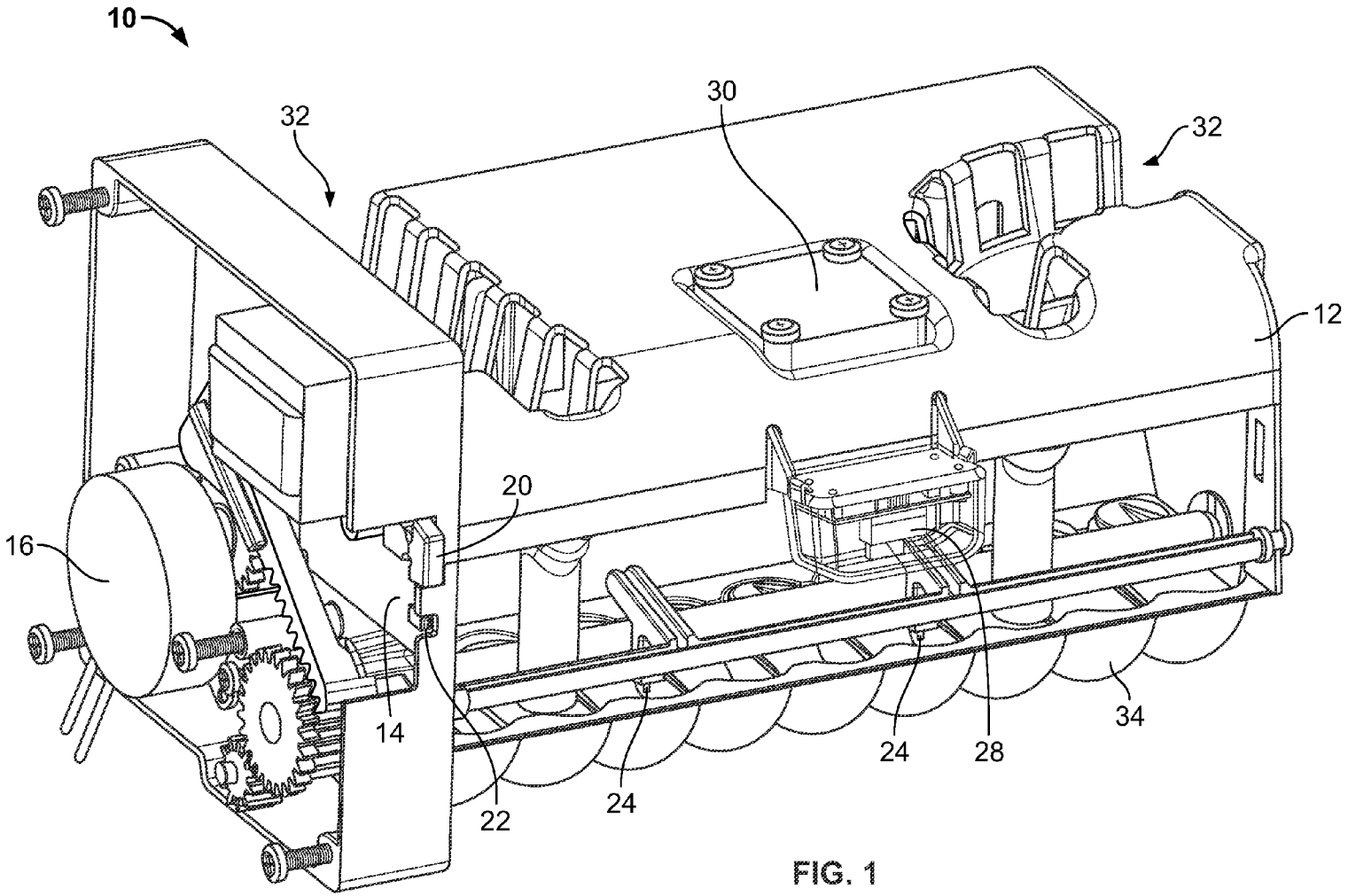
FIG. 1 is a perspective view of an ice maker implementing the present invention.

Examples of embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

The present invention may be embodied in refrigerators equipped with an ice maker. Although refrigerators commonly have a freezer compartment providing a below-freezing temperature environment and a fresh-food compartment providing an above-freezing temperature environment, the refrigerator in which the present invention is implemented need not include both types of compartment. The types of refrigerator in which the ice maker is located may vary and the refrigerator may be of a domestic type that is top mounted, bottom mounted, side-by-side mounted or otherwise in configuration. The present invention is also applicable to commercial refrigerators for storing merchandise. Moreover, the ice maker may be located in either of a freezer compartment or a fresh-food compartment. In case of an ice maker located at the fresh-food compartment, a means of insulating the ice from the above-freezing temperature environment may be provided.

FIG. 1 shows one embodiment of an ice maker 10 implemented with the present invention. The ice maker 10 may include among other features a main housing 12, a control housing (not shown), a control board 14, a front cover (not shown), a motor 16, an on/off switch 20, a manual cycle button 22, a water level sensor 24, an ice mold 34, an infrared sensor 28, a fan 30 and water fills 32.

Figure 2:
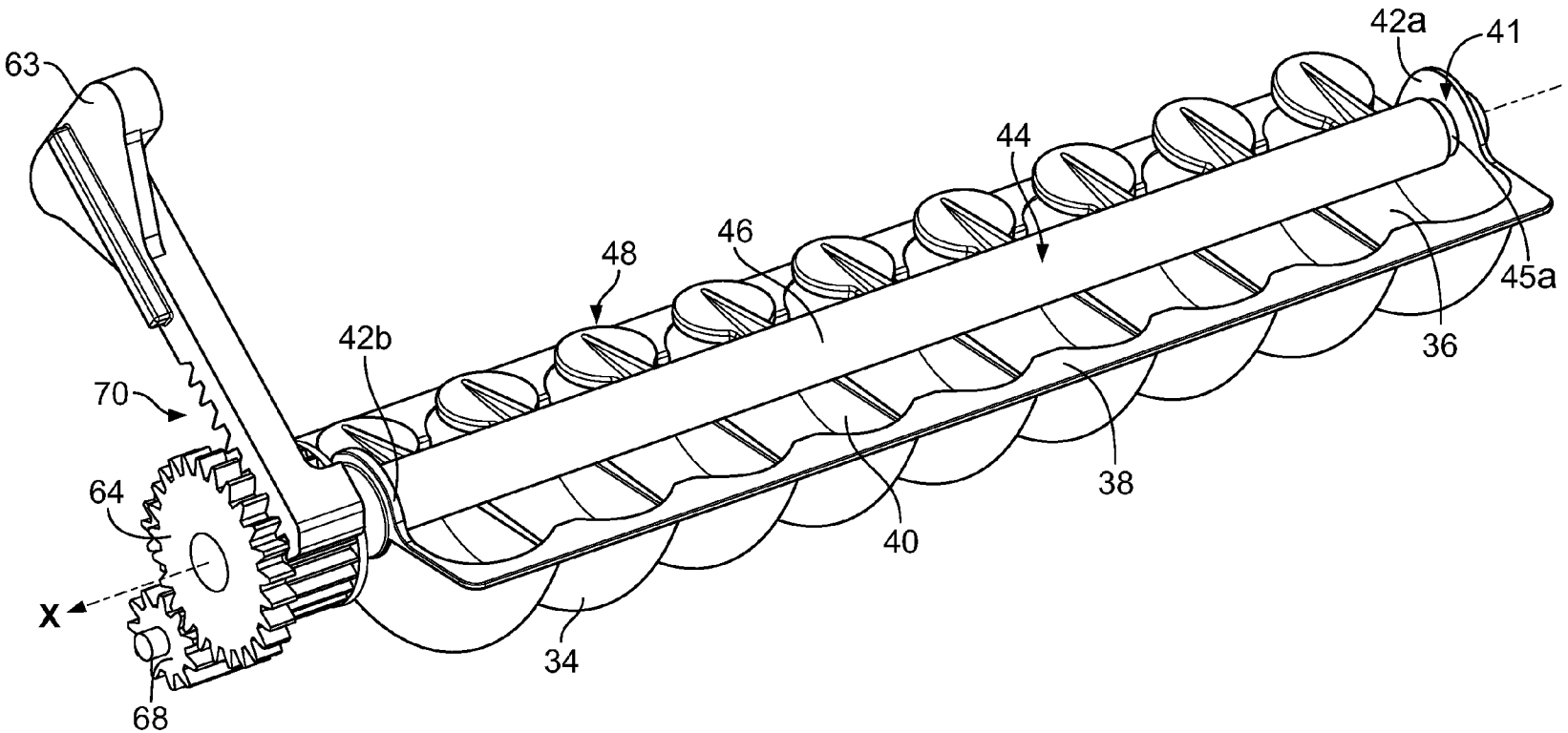
FIG. 2 is a view of an ice mold, a sweeping element and a gear train isolated from the ice maker prior to a harvesting step.
Figure 4:
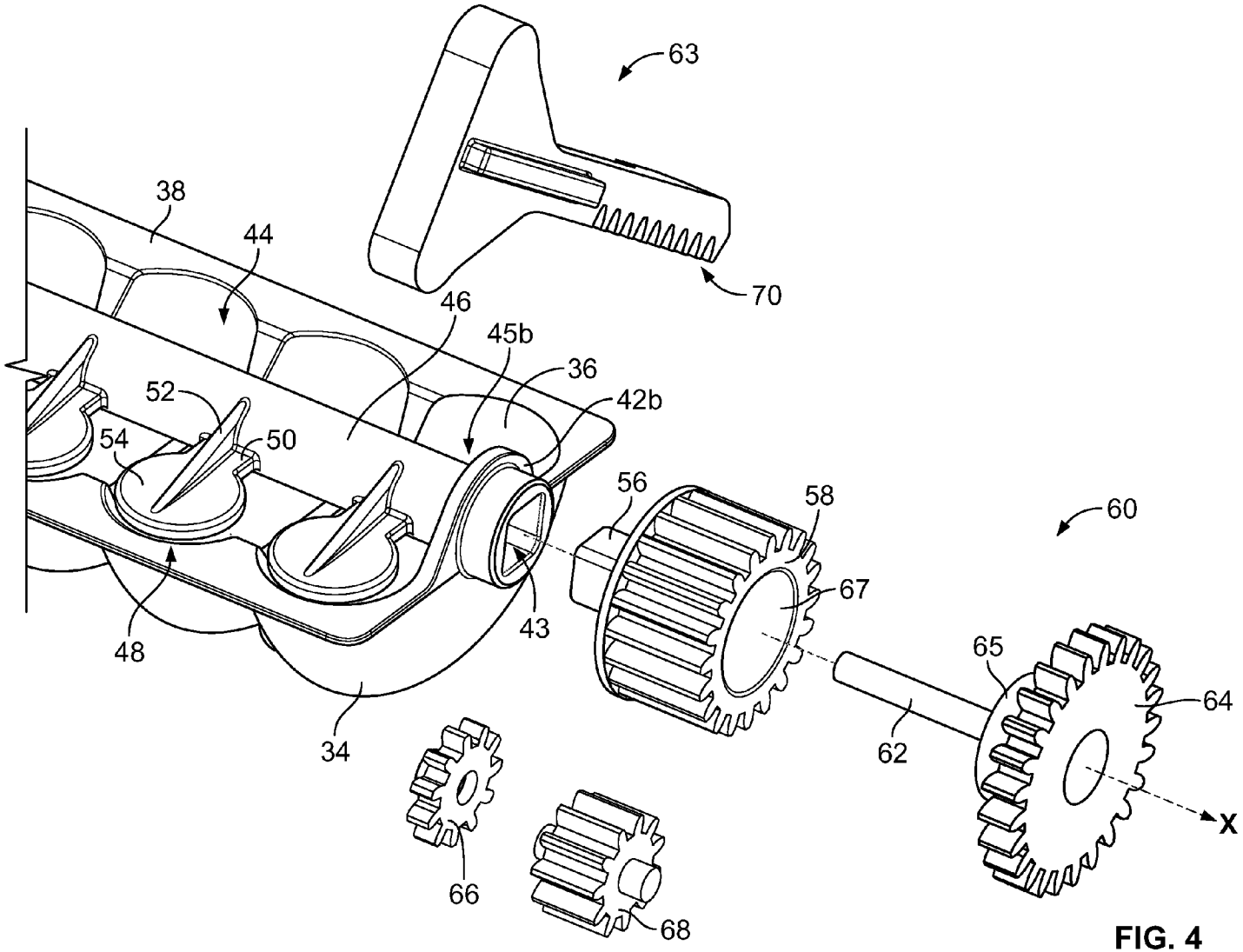
FIG. 4 is an exploded view of the gear train and the crank.
Figure 5:
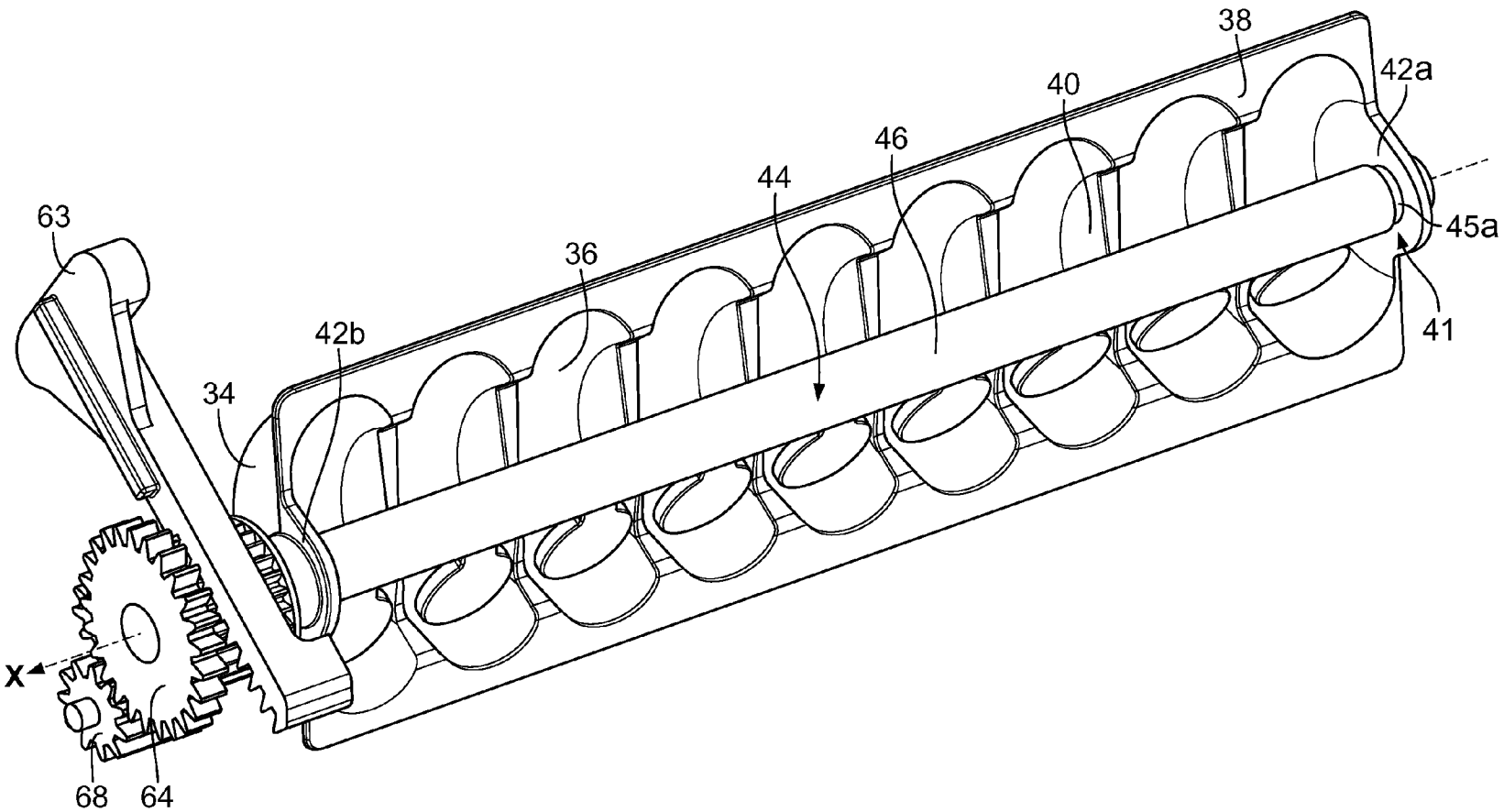
FIG. 5 is a view of the ice mold, the sweeping element and the gear train during the harvesting step.

FIGS. 2 and 5 provide a view of the ice mold 34 and some relevant features isolated from the rest of the ice maker 10. The ice mold 10 acts as a receptacle and includes a plurality of cavities 36 in which water can be stored for ice making in controlled temperature environments. The interior of the cavities 36 are shaped like semi-wheels or semi-disks in this embodiment although can a variety of other shapes is also possible. A horizontal flange 38 substantially surrounds the ice mold 34 along its periphery. The cavities 36 are separated by walls 40 that are lower than the flange 38 such that, when water is poured into the ice mold 34 and fills one cavity 36, the water is allowed to spill into a neighboring cavity 36 and eventually fill up all of the cavities 36. At each longitudinal end, the ice mold 34 includes vertical tab 42*a* and 42*b* that includes respectively apertures 41, 43 (FIGS. 3-4) extending through the tabs 42*a* and 42*b*. The ice mold 34 is configured to rotate about an axis X that extends longitudinally through the tabs 42*a*, 42*b* and is spaced apart from the cavities 36. A sweeping element 44 is configured to extend between the vertical tabs 42*a*, 42*b* and to be also rotatable about the axis X but in an opposite direction relative to the rotation of the ice mold 34.

The sweeping element 44 may include a shaft 46 with a circular cross-section and one or more paddle-like fingers 48 that radially extend from the shaft 46. The shaft 46 may have an end 45*a* with a diameter that is smaller than the rest of the shaft 46 and that is dimensioned to slidingly fit within the aperture 41 with a circular cross-section such that the shaft 46 and the sweeping element 44 can rotate independently of the ice mold 34. A portion of the shaft 46 may or may not extend into the tabs 42*a* and 42*b* while extending therebetween.

Figure 3:
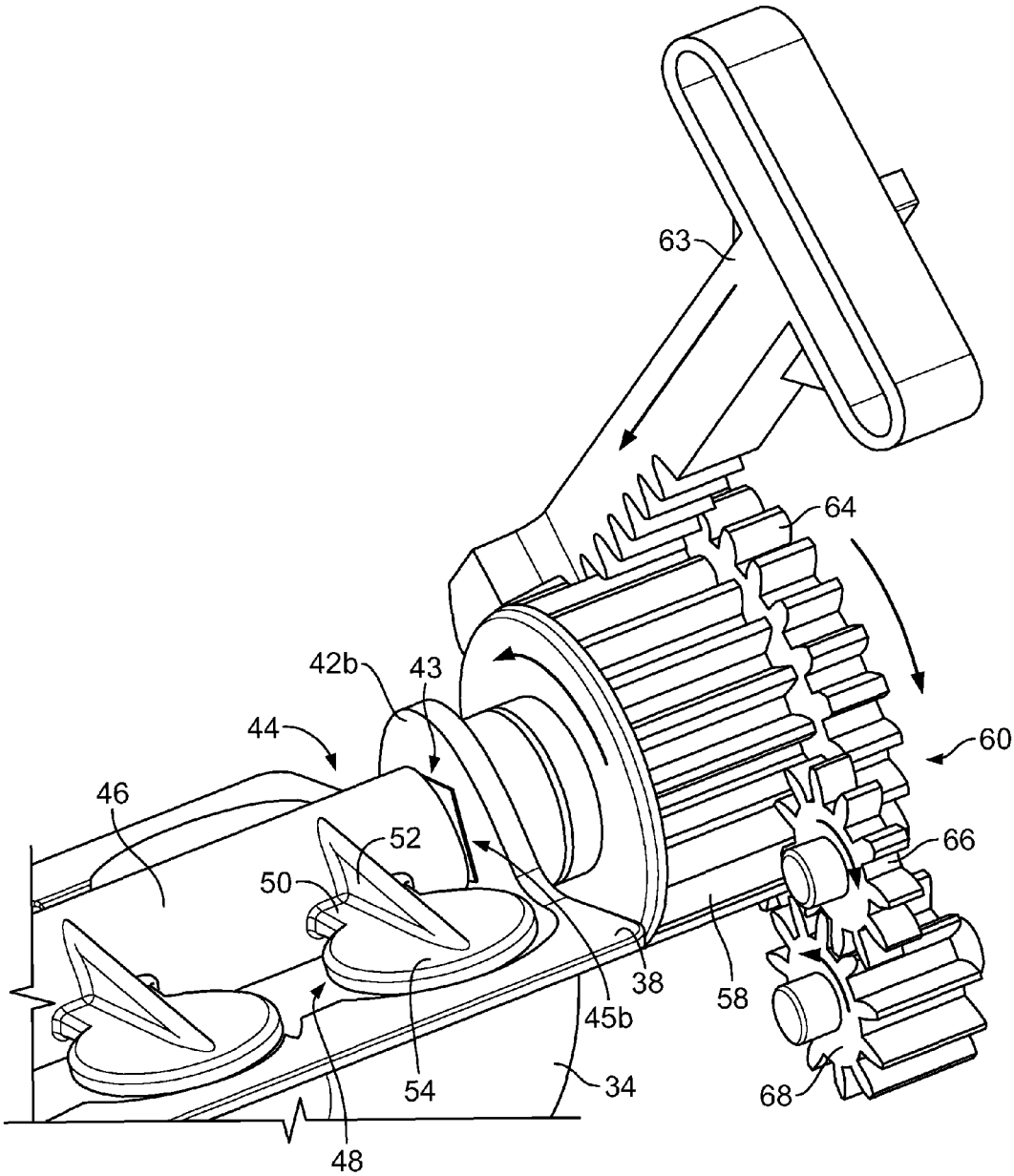
FIG. 3 is a view of the gear train and a crank.

The fingers 48 are axially spaced apart along the shaft 46 such that each finger 48 corresponds to a cavity 36 on the ice mold 34 and extends into the cavity 36 upon rotation of the shaft 46. As shown in FIGS. 3-4, each finger 48 may include a base section 50, a support section 52 and a blade section 54 and may be dimensioned such that the blade section 54, which is found at an extremity of the finger 48, closely sweeps past an inner surface of the cavity 36 tracing or following an inner geometry of the cavity 36 as the sweeping element 44 is rotated about the axis X. The fingers 48 may also be configured to contact or graze the inner surface of the cavities 36. In this embodiment, the blade section 54 is circular so that, when the sweeping element 44 is rotated, a path of the blade section 54 forms a segment of a torus which would substantially fit the semi-wheel shaped inner geometry of the cavity 36.

The angular position of the fingers 48 along the shaft may be identical or may vary sequentially. In this embodiment, the angular position of each finger 48 is different. When viewed relative to the angular position of the finger 48 closest to the motor 16, the angular positions of the subsequent fingers 48 relative to this default angular position are staggered so as to be incrementally offset or displaced in a clockwise direction about the axis X along the shaft 46 in FIG. 2. In other words, a subsequent finger 48 is angularly oriented at a more clockwise position compared to an antecedent finger 48. Such a staggered configuration allows the motor torque to be fully applied during rotation to each individual ice cube in order to more easily dislodge each ice cube from its cavity 36 and reduce the likelihood of the motor 16 being stalled from having to eject all the ice cubes out of the cavities 36 at once.

The ice mold 34 and the fingers 48 may be made of materials with desired characteristics such as rigidity, durability, flexibility or malleability under operating conditions such that the ice mold 34 and the fingers 48 can operate effectively while undergoing some deformation during the ice making and harvesting operations. Excessive flexibility may counteract the effect of the staggered orientation of the fingers and some rigidity of the fingers 48 is desired in order to properly transmit the torque of the motor onto the ice cubes.

As shown in FIG. 1, the rotation of the sweeping element 44 and the ice mold 34 may be powered by an AC motor 16 and is transmitted through a slider-crank mechanism and a gear train 60 that includes a number of gears. The rotation of the motor 16 is controlled to move the crank 63 in either of two directions along a line depending on which the rotational direction of the gears will vary. Referring to FIGS. 3-4, the vertical tab 42*b* of the ice mold 34 may include a keyed aperture 43 that is configured to interlock with a male key 56 located on a first gear 58. The keyed aperture 43 acts as a female portion in this key connection and the male key 56 is formed about the axis X such that the first gear 58 and the ice mold 34 can rotate as one. A cross section of the male key 56 and the keyed aperture 43 is shown as a rectangle but may also have asymmetrical shapes, such as an isosceles triangle or trapezoid, about the axis X such that the male key 56 can fit in the keyed aperture 43 in only one predetermined manner automatically orienting the ice mold 34 about the first gear 58. Moreover, the shaft 46 of the sweeping element 44 includes a first bore (not shown) that is configured to accommodate a rod 62 of a second gear 64 which is long enough to extend thereinto. Thus, unlike the end 45*a*, an end 45*b* of the shaft 46 does not extend into the tab 42*b* in this embodiment and the first bore of the shaft 46 is simply in communication with the keyed aperture 43 of the tab 42*b*. The first gear 58 provides a second bore (not shown) large enough for the rod 62 to extend past the first gear 58 and into the first bore. The shaft 46 and the rod 62 may each include a radially extending slot that can become aligned in an assembled state such that insertion of a metal pin into the slot can force the shaft 46 and the rod 62 to rotate as one. Alternatively, the first bore and the rod 62 may connected through a keyed mechanism similar to the keyed aperture 43 and the male key 56. Thus, the sweeping element 44 and the second gear 64 can rotate as one, and the second bore of the first gear 58 is dimensioned such that the first gear 58 is unaffected by the rotation of the second gear 64 and the sweeping element 44. A cylinder portion 65 of the second gear 64 is configured to fit within a cylindrical hole 67 of the first gear 58 and facilitate alignment of the second gear 64 with the first gear 58 about the axis X and consequently about the shaft 46. As a result of the above configurations, the first gear 58 and the second gear 64 can rotate concentrically but independently of one another about the axis X.

In an alternative embodiment, it may be possible to provide ends like the end 45*a* and apertures like the aperture 41 on both sides of the shaft 46 and mount the sweeping element 44 to the ice mold 34 via snap-in connection. In such an embodiment, the aperture 43 may have a first section with a circular cross-section and a second section with a keyed cross-section. The shaft 46 may have an end similar to the end 45*a* that extends into the first section while the male key 56 extends only up to the second section.

As shown in FIG. 3, the rotation of the motor 16 is transmitted to the first gear 58 through the linear movement of the crank 63 engaging the first gear 58. The rotation of the first gear 58 is transmitted through additional gears in the gear train 60 such as third and fourth gears 66, 68. The first gear 58 is meshed with the third gear 66 which is meshed with the fourth gear 68 which engages the second gear 64. Thus, the gear train 60 causes the first gear 58 and the second gear 64 to rotate in opposite directions such that the ice mold 34 and the sweeping element 44 can either move toward or away from one another.

The length of a rack portion 70 on the crank 63 can be adjusted such that the linear movement of the crank 63 will result in a predetermined amount of rotation for the first and second gears 58, 64. In one embodiment, during one harvesting step, the sweeping element 44 and the fingers 48 can rotate approximately 90 degrees in a counterclockwise direction about the axis X while the ice mold 34 can rotate approximately 90 degrees in a clockwise direction about the axis X, as shown in FIG. 5. In an alternative embodiment, the sweeping element 44 can rotate about 80 degrees while the ice mold 34 can rotate about 100 degrees. The fingers 48 and the ice mold 34 start out at a substantially horizontal position and lateral to the shaft 46 at an ice making position before a harvesting step begins, and end up in a substantially vertical position below the shaft 46 after the harvesting step occurs. The fingers 48 and the ice mold 34 then return to the horizontal position to allow for ice making again. Although the sweeping element 44 rotates only about 90 degrees, due to the relative movement of the sweeping element 44 and the ice mold 34, the blade sections 54 are able to sweep through almost the entire inner geometry of the cavities 36 during the harvesting step. At the end of the harvesting step, the ice mold 34 may reach a substantially upright position whereas the fingers 48 may become oriented downwardly and end up near the other side of cavities 36 such that the ice cubes can fall from the ice mold 34 once pushed out of the cavities 36 to an underlying ice storage area or receptacle.

The present invention allows ice cubes to be easily removed from the cavities 36 of the ice mold 34. Because the ice mold 34 is rotated in a direction opposite that of the sweeping element 44, there is no need for the fingers 48 to push the ice cubes up and over a side of the ice mold 34 and the resistance encountered by the fingers 48 during their rotation is reduced. In the present invention, the ejection of ice cubes can be achieved even though the range of motion by the fingers 48 is reduced. Moreover, the corresponding shapes of the blade section 54 and the cavities 36 allow the inner geometry of the cavities 36 to be swept thoroughly decreasing the likelihood of smaller ice cubes escaping the sweeping motion. Moreover, the staggered fingers 48 enable the torque of the motor 16 to be separately applied to each ice cube reducing the strain on the motor 16 and making the ejection of ice cubes from the ice mold 34 more likely.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An ice maker including:

an ice mold including a plurality of cavities and configured to be rotatable about an axis that is spaced apart from the cavities and extends longitudinally with respect to the ice mold; and a sweeping element configured to be rotatable about the axis and including a shaft with a plurality of fingers radially extending from the shaft, each of the fingers configured to extend into a corresponding one of the cavities upon rotation of the shaft about the axis, wherein, during a harvesting step, the ice mold is configured to rotate in a first direction about the axis while the sweeping element is configured to rotate in a second direction about the axis that is opposite the first direction, and wherein the ice maker further comprises a crank and a gear train including a first gear and a second gear, the ice mold is interlocked to rotate with the first gear, the sweeping element is interlocked to rotate with the second gear that is concentric and rotatable about the first gear, the crank is operatively connected to the first gear to rotate in the first direction, and the second gear operatively connected via the gear train to the first gear to rotate in the second direction.

2. The ice maker of claim 1, wherein, during the harvesting step, the ice mold is rotated about 90 degrees in the first direction about the axis while the sweeping element is rotated about 90 degrees in the second direction about the axis.

3. The ice maker of claim 1, wherein the fingers and the ice mold move from a substantially horizontal position to a substantially vertical position during the harvesting step.

4. The ice maker of claim 1, wherein the fingers are arranged sequentially along the shaft so as to be incrementally offset in angular position from a default angular position.

5. The ice maker of claim 1, wherein each finger terminates in a blade section that is shaped to substantially trace an inner geometry of the cavities upon rotation during the harvesting step.

6. The ice maker of claim 5, wherein each cavity is semi-wheel shaped and the blade section is circular so that a segment of a torus that is traced by the blade section through the rotation of one of the fingers substantially fits each cavity.

7. The ice maker of claim 1, wherein the ice mold includes a pair of tabs at longitudinal ends, and the shaft extends between the tabs.

8. An ice maker including:

an ice mold including a plurality of cavities and configured to be rotatable about an axis that is spaced apart from the cavities and extends longitudinally with respect to the ice mold; and a sweeping element configured to be rotatable about the axis and including a shaft with a plurality of fingers radially extending from the shaft, each of the fingers configured to extend into a corresponding one of the cavities upon rotation of the shaft about the axis, each finger terminating in a blade section, wherein the fingers are arranged sequentially along the shaft so as to be incrementally offset in angular position from a default angular position, wherein each cavity is semi-wheel shaped and the blade section is circular so that a segment of a torus that is traced by the blade section through the rotation of one of the fingers substantially fits each cavity, wherein during a harvesting step, the ice mold is configured to rotate in a first direction about the axis while the sweeping element is configured to rotate in a second direction about the axis that is opposite the first direction, and wherein the ice maker further comprises a crank and a gear train including a first gear and a second gear, the ice mold is interlocked to rotate with the first gear, the sweeping element is interlocked to rotate with the second gear that is concentric and rotatable about the first gear, the crank is operatively connected to the first gear to rotate in the first direction, and the second gear operatively connected via the gear train to the first gear to rotate in the second direction.

9. The ice maker of claim 8, wherein each finger terminates in a blade section that is shaped to substantially trace an inner geometry of the cavities upon rotation during a harvesting step.

10. The ice maker of claim 8, wherein, during the harvesting step, the ice mold is rotated about 90 degrees in the first direction about the axis while the sweeping element is rotated about 90 degrees in the second direction about the axis.

11. The ice maker of claim 8, wherein the fingers and the ice mold move from a substantially horizontal position to a substantially vertical position during the harvesting step.

12. The ice maker of claim 8, wherein the ice mold includes a pair of tabs at longitudinal ends, and the shaft extends between the tabs.

* * * * *